United States Patent [19]

Coffman et al.

[11] 4,029,570

[45] June 14, 1977

[54] PROCESS FOR RECOVERING CRUDE OIL FROM AN UNDERGROUND RESERVOIR

[75] Inventors: Charles L. Coffman, Wichita, Kans.; Glen F. Kellerhals, Tulsa, Okla.; Jack Newcombe, Freehold; Shirley H. Roth, Highland Park, both of N.J.

[73] Assignee: Cities Service Company, Tulsa, Okla.

[22] Filed: Mar. 29, 1976

[21] Appl. No.: 671,187

[52] U.S. Cl. ..... 208/188; 166/267
[51] Int. Cl.[2] ..... C10G 33/00
[58] Field of Search ..... 208/188, 187; 166/265, 166/267; 210/51, DIG. 27

[56] References Cited

UNITED STATES PATENTS

| | | | |
|---|---|---|---|
| 1,639,325 | 8/1927 | Born et al. | 208/188 |
| 1,990,293 | 2/1935 | Lerch | 208/188 |
| 2,288,857 | 7/1942 | Subkow | 166/267 |
| 3,612,178 | 10/1971 | Germer, Jr. et al. | 166/267 |
| 3,798,153 | 3/1974 | Arndt, Jr. et al. | 208/187 |

*Primary Examiner*—George Crasanakis
*Attorney, Agent, or Firm*—E. F. Gunn

[57] ABSTRACT

An emulsion of crude oil and water that is recovered from an underground reservoir is broken by the addition of a naturally occurring brine to effect separation and recovery of the oil phase of the emulsion. Advantageously, brine taken from the same geologic formation as the crude oil can be used as the emulsion breaker.

17 Claims, No Drawings

PROCESS FOR RECOVERING CRUDE OIL FROM AN UNDERGROUND RESERVOIR

BACKGROUND OF THE INVENTION

This invention pertains to recovery of petroleum from underground reservoirs and pertains in particular to the breaking of emulsions of crude oil and water that are recovered from a producing well of the reservoir.

Recovered liquid from a producing well can be in the form of oil and water emulsions which are quite stable, especially when they comprise a surfactant which was introduced into the reservoir for enhancing the recovery of crude oil therefrom, e.g. as during secondary and/or tertiary recovery processes. Accordingly, a surfactant can be introduced into the reservoir in the form of a solution or dispersion which is either miscible with the crude oil or else exhibits lower interfacial tension therewith. Following introduction of a surfactant, a drive water slug which has been thickened by means of a polymer, such as a polyacrylamide or Kelzan, can be injected into the reservoir for the purpose of displacing crude oil toward and through a producing well. Emulsion of the crude oil with water can thus be a result of mixture of the oil with water which was introduced into the reservoir as a carrier medium for the surfactant and/or for driving displaced crude oil toward a producing well.

There is presently an ascendancy of secondary and tertiary processes for recovery of petroleum since there is an ever increasing demand for oil and since more of such processes are now beginning to appear economically attractive. The favorable economics thereof will nonetheless be largely dependent upon the cost of breaking the oil and water emulsions that are consequently produced by these methods, and especially when a produced emulsion is rendered quite stable by consequential content of a surfactant, such as a petroleum sulfonate, that was introduced into a reservoir for the purpose of improving displacement and recovery of crude oil therefrom.

Broadly speaking, therefore, one object of the present invention is to provide an improved method for separating crude oil from water when these two fluids are recovered as a mixture from a petroleum reservoir.

Another object is to provide a method for separating crude oil from emulsions of crude oil and water.

Still another object is to provide an improved method of separating crude oil from emulsions of oil and water that are produced from a well in a petroleum reservoir.

Yet another object is to provide an improved method of separating crude oil from an emulsion which comprises crude oil, a surfactant and water.

Even another object is to provide a method for recovering crude oil from an emulsion of crude oil and water that is stabilized by a sulfonate.

A further object is to provide an inexpensive method of breaking emulsions of crude oil and water.

Other objects and advantages of the invention will become apparent from the following description and the appended claims.

SUMMARY OF THE INVENTION

In accordance with the present invention, an emulsion of crude oil and water that is produced from a well in an underground reservoir is mixed with a naturally occurring brine, the mixure is agitated to break the emulsion, and the crude oil is then separated from the water of the resulting broken emulsion. The naturally occurring brine that is used as the emulsion breaker can be taken from the surface of the earth, e.g. seawater, or from beneath the surface. It can be pumped from below the surface in the vicinity of the well from which the emulsion is produced, if present there, or can be transported by pipeline from a remote location. By use of natural brine as opposed to a salt solution which must be made up from purchased raw materials, a practical, low-cost emulsion breaking method can be carried out at the site where the emulsion is first recovered from the producing well.

DESCRIPTION OF PREFERRED AND ALTERNATIVE EMBODIMENTS

As was previously indicated, the present invention can be employed to advantage in recovery of crude oil from emulsions of the oil with water, whether the emulsion be of the water external (o/w) or oil external (w/o) variety. The emulsion can thus be one that forms during production of oil-water mixtures through a well, and in cases wherein one or more emulsifying agents occur naturally within the oil being produced, e.g. iron sulfide, asphalt, resinous substances, and oil-soluble organic acids.

The present invention is especially applicable in processes wherein an extraneous surfactant is introduced into a reservoir for enhancing recovery of crude oil and from which an emulsion of crude oil and water is subsequently produced that contains the surfactant. Such emulsions can be produced as a consequence of secondary recovery operations following introduction of an aqueous solution of a surfactant into the reservoir, or following introduction of a surfactant-containing micro-emulsion during a tertiary recovery operation, and in which case the micro-emulsion can be either water external or oil external. The produced oil-water emulsions which forms as a result of secondary or tertiary recovery operations can be either water external (o/w), or oil external (w/o), but they are usually water external.

The natural brine that is used for breaking an emulsion in accordance with the present invention can be seawater, or ground water which contains one or more salts of an alkali metal or an alkaline earth metal salt, i.e. salts of sodium, potassium, calcium, magnesium and barium. If necessary, the brine can be transported from a point of origin to a remote location where the emulsion is broken, but preferably the brine can be taken from the same producing field wherein the well resides from which the emulsion is being produced. Therefore, a formation brine intended for mixture with the emulsion can be pumped from underground through a separate well, and if available and suitable, the brine can be taken from the same geologic formation from which the crude oil in the form of an emulsion is produced.

Suitable natural brines will have a total content of dissolved alkali metal salts and/or alkaline earth metal salts within the broad range of about 2–65% by weight, generally about 2–30% by weight, frequently 3–15% by weight, and commonly about 4–7% by weight. (The combined content of these salts in seawater is about 6.5% by weight.)

It is felt that both the monovalent and divalent ions made available by the aforementioned salts operate as antagonist in breaking of the emulsions, and presence of the divalent ions is preferred, especially when the emulsion is stabilized by means of a petroleum sulfonate. In naturally occurring brines the presence of alkaline earth metals in ionized form can range up to 20% or more of the combined total content of alkali metal and alkaline earth metal salts, and are commonly present in amounts within the range of about 3–15% by weight when the contined total content of the alkali metal and alkaline earth metal salts is within the range of about 2–30% by weight.

Preferred brines will have a combined total weight of alkali metal and alkaline earth metal salts within the range of about 2–30% by weight of the brine and wherein the content of one or more alkaline earth metals is present in an amount of about 3–15% by weight of total combined weight of the alkali metal salts and alkaline earth metal salts. Accordingly, suitable brines can contain at least about one part of an ionized alkaline earth metal per 30 parts of the combined total of alkali earth and alkaline earth metal salts, more frequently, one part of ionized alkaline earth per 2–14 parts of the total, commonly 4–7 parts. Since the invention can sometimes be practiced by incorporation of brine into an emulsion whereby the content of dissolved alkali metal and alkaline earth metal salts therein is as little as 500 parts per million, it will be appreciated that the brine can sometimes be diluted with fresh water prior to addition to the emulsion, thus further reducing the cost of using brine.

As is well known in the art, surfactants and cosurfactants that are introduced into a petroleum reservoir during a secondary or tertiary recovery process for petroleum can be selected from a great variety of anionic, nonionic and cationic surfactant, and it will thus be appreciated that the stability of a given oil and water emulsion in the presence of brine will be dependent, inter alia, upon the type of the one or more surfactants present therein, the amount and type of salts incorporated into the emulsion by addition of the brine, the temperature, whether the water phase is internal or external, the type of oil, and the globule size of the noncontinuous phase of the emulsion. In order to determine the type and amount of salts needed to break a particular emulsion, simple experiments can be run while using this disclosure as a guideline.

In order to provide specific examples, the invention will be further described with reference to emulsions which contain specified surfactants and use of a specified brine as the emulsion breaker. Particular emphasis will be given to the breaking of emulsions which contain sulfonates, and more particularly sodium petroleum sulfonate, calcium petroleum sulfonate, and barium petroleum sulfonate, since sulfonates are very frequently a surfactant of choice in a secondary or tertiary recovery process for petroleum. Their use can result in formation of fairly stable emulsions of crude oil and water when the content of petroleum sulfonate therein is at least about 0.005 weight percent, and in which case the emulsion can sometimes by broken by incorporation of as little as 500 ppm of the one or more salts of the brine therein. Such emulsions will frequently contain at least about 0.025 weight percent of petroleum sulfonate and can be broken by incorporation of from about 2000 to about 250,000 ppm of one or more of the salts of the brine. In more specific yet frequently occurring instances, the emulsions will contain from about 0.25 to about 2.5 weight percent of petroleum sulfonate and can be broken by incorporation of from about 2000 ppm to about 40,000 ppm, more frequently from about 3000 ppm to about 20,000 ppm, of at least one of the salts of the brine therein. Preferred petroleum sulfonates for use in secondary and tertiary recovery processes for petroleum have an average molecular weight within the range of about 350 to about 500. Synthetic petroleum sulfonates can be used.

EXAMPLES

Formation brine containing 10.0 wt.% salt content ws used to break prototype oil-in-water (o/w) emulsions prepared from oil external micellar fluid, crude oil, and drive water. Salts on the brine consisted of sodium chloride 84.8 wt.%, potassium chloride 0.3 wt.%, calcium chloride 6.1 wt.%, magnesium chloride 8.1 wt.% and barium chloride 0.7 wt.%. The oil external micellar fluid comprised about 77.5 weight percent crude oil, about 4.5 weight percent water, and 15 weight percent of sodium petroleum sulfonate surfactants.

O/W EMULSIONS PREPARED FROM OIL EXTERNAL MICELLAR FLUID

Twenty ml of the micellar fluid above was placed in a 100 ml stoppered graduate cylinder with 80 ml of soft water containing 170 ppm total hardness. The oil and water were shaken vigorously by hand for 1 minute. A tan macro o/w emulsion formed that was stable to change for an indefinite period. After standing for 7 days less than 1 ml of a macro o/w cream top layer separated. This is an example of the type of stable o/w emulsion that can be produced during a low tension or miscible tertiary oil recovery process. Because of its high sulfonate content, the emulsion did not respond to treatment with organic demulsifiers that are used to treat normal w/o (water-in-oil) emulsions usually encountered in produced crude oil.

EXAMPLE 1

Breaking High Sulfonate Content o/w Emulsions With Oil Field Brine

Emulsions were prepared by stirring 130 ml of the micellar fluid with 455 ml of soft water containing 170 ppm total solids by stirring at the high speed of a Waring Laboratory Blender for 2 minutes. Exactly 90 ml of the tan o/w emulsion was placed in each of several 100 ml stoppered graduated cylinders. This quantity, 90 ml, of emulsion contained 19 ml of micellar fluid oil. Ten ml of the soft water was added to graduate 2-0. The graduate was shaken vigorously for 1 minute and allowed to stand. The resulting emulsion was stable, no separation of oil or cream was observed on standing 24 hours. In other tests 2-1 through 2-10, 1 through 10 ml of oil field brine containing 10% salt concentration was added along with enough salt water to make exactly 100 ml of emulsion which was 20 volume % oil. Each graduate was shaken vigorously for 1 minute and allowed to stand. Observation on stability of the emulsion was made at frequent intervals for 24 hours. Observed results are shown in Table I.

TABLE I

| Exp. | ml Brine Added | Conc. of Salts in Emulsion ppm | Observation of Stability of the o/w Emulsion | | |
|---|---|---|---|---|---|
| | | | Initial | 4 hr. | 24 hrs. |
| 2–0 | 0 | ca 170 | Stable | Stable | Stable |
| 2–1 | 1 | 1000 | Stable | Stable | Stable |
| 2–2 | 2 | 2000 | Stable | Stable | Stable |
| 2–3 | 3 | 3000 | Stable | Stable | Stable |
| 2–4 | 4 | 4000 | Breaking | 34% ma w/o | 37% ma w/o |

TABLE I-continued

| Exp. | ml Brine Added | Conc. of Salts in Emulsion ppm | Observation of Stability of the o/w Emulsion Initial | 4 hr. | 24 hrs. |
|---|---|---|---|---|---|
| | | | | 66% ma o/w | 63 dw |
| 2-5 | 5 | 5000 | Breaking | 29% ma w/o | 29 mi w/o |
| | | | | 71 ma o/w | 71 dw |
| 2-6 | 6 | 6000 | Breaking | 27 ma w/o | 27 mi w/o |
| | | | | 73 dw | 73 dw |
| 2-7 | 7 | 7000 | Breaking | 25 ma w/o | 25 mi w/o |
| | | | | 75 dw | 75 dw |
| 2-8 | 8 | 8000 | Breaking | 24 ma w/o | 24 mi w/o |
| | | | | 76 dw | 76 hw |
| 2-9 | 9 | 9000 | Breaking | 24 ma w/o | 23 mi w/o |
| | | | | 76 dw | 77 hw |
| 2-10 | 10 | 10000 | Breaking | 23 ma w/o | 23 mi w/o |
| | | | | 77 dw | 77 hw |

Abv.:
ma — macro
w/o — water-in-oil emulsion
dw — dirty water
mi — micro
o/w — oil-in-water emulsion
hw — hazy water The water layer in Exps. 2-8, 2-9 and 2-10 contained only a trace of oil after standing 24 hours. These tests show that oil field brine will result in a rapid break of o/w emulsions stabilized by a large amount of sulfonate, 2.64 wt.% of the emulsion.

EXAMPLE 2

Breaking Lower Sulfonate Content Prototype o/w Emulsion with Brine

Another o/w emulsion was prepared by blending 10 parts of micellar fluid with 90 parts of crude oil to produce an oil containing 1.5 wt.% sulfonates. O/w emulsions containing 20 vol.% oil and soft water were prepared as in Example 2. This emulsion was stabilized by 0.264 wt.% sulfonates.

In a series of experiments oil field brine containing 10% salts was added to each of a series of graduates containing the 20% oil (o/w) emulsion shown in Table II.

TABLE II

| Exp. No. | Ml Brine Added | Conc. of Salts in Emulsion ppm | Observation of Stability of the o/w Emulsion Initial | 4 hrs. | 24 hrs. |
|---|---|---|---|---|---|
| 3-0 | 0 | 170 | Stable | Stable | Stable |
| 3-1 | 1 | 1000 | Stable | Slight Break | 16 ma o/w |
| | | | | | 84 ma o/w |
| 3-2 | 2 | 2000 | Stable | 15 ma o/w | 15 ma w/o |
| | | | | 85 ma o/w | 85 ma o/w |
| 3-3 | 3 | 3000 | Breaking | 20 ma w/o | 21 ma w/o |
| | | | | 80 dw | 80 dw |
| 3-4 | 4 | 4000 | Breaking | 20 ma w/o | 21 ma w/o |
| | | | | 80 dw | 79 dw |
| 3-5 | 5 | 5000 | Breaking | 20 ma w/o | 20 ma w/o |
| | | | | 80 dw | 80 dw |
| 3-10 | 10 | 10000 | Breaking | 20 ma w/o | 20 mi w/o |

TABLE II-continued

| Exp. No. | Ml Brine Added | Conc. of Salts in Emulsion ppm | Observation of Stability of the o/w Emulsion Initial | 4 hrs. | 24 hrs. |
|---|---|---|---|---|---|
| | | | | 80 dw | 80 clear water |

Abv.:
ma — macro
w/o — water-in-oil eulsion
dw — dirty water
mi — micro
o/w — oil-in-water emulsion In this lower sulfonate content emulsion, which is probably more akin to an emulsion produced in a secondary or tertiary recovery project, only 3000 ppm of salts added is sufficient to break the o/w emulsion.

O/W EMULSIONS PREPARED FROM WATER-EXCHANGED MICELLAR FLUIDS

A water external micellar emulsion was prepared which comprised about 92 weight percent water and about 8 weight percent of sodium petroleum sulfonates and sodium alcohol ethoxylate sulfate surfactants.

An o/w emulsion was prepared by mixing 260 ml of water-external micellar fluid and 130 ml of crude oil for 2 minutes at the high speed of a Laboratory Waring Blendor. Exactly 60 ml of this o/w emulsion and 40 ml of soft water were placed in a stoppered 100 ml graduated cylinder and shaken vigorously by hand for 2 minutes. On standing for 24 hours the emulsion slowly separated into two o/w emulsion phases that were stable without further change for several weeks. The results of this test are in Table III as Experiment 7-0. This emulsion was stabilized by the following emulsifiers:

| | |
|---|---|
| Sodium petroleum sulfonate, Ave. Mol. Wt. 470 | .683 wt.% |
| Sodium petroleum sulfonate, Ave. Mol. Wt. 340 | .505 wt.% |
| Sodium alcohol ethoxylate sulfate, Ave. Mol. Wt. 442 | .275 wt.% |
| TOTAL | 1.463 wt.% |
| High molecular wt. polyacrylamide polymer | 0.003 wt.% |

EXAMPLE 3

Breaking High Surfactant Content o/w Emulsions With Oil Field Brine

In other tests, 60 ml of tan o/w emulsion which contains 20 ml of oil, was placed in 100 ml stoppered graduates. Using the same oil field brine as in Examples 1 and 2, enough of the brine and soft water were added to make 100 ml of o/w emulsion. Each observation on stability of the emulsion was made at frequent intervals. The following results were observed:

TABLE III

| Exp. No. | Ml Brine Added | Conc. of Salts in Emulsion ppm | Observation of Stability of the o/w Emulsion Initial | 1 hr. | 4 hrs. | 24 hrs. |
|---|---|---|---|---|---|---|
| 7-0 | 0 | 0 | Tan | 94 ma o/w | 71 ma o/w | 30 ma o/w |
| | | | Stable | 6 ma o/w | 29 ma o/w | 70 ma o/w |
| 7-10 | 10 | 10,000 | Tan | 95 ma o/w | t ma w/o | t ma w/o |
| | | | Stable | 5 ma o/w | 75 ma o/w | 20 ma w/o |
| | | | | | 25 ma o/w | 80 ma o/w |
| 7-20 | 20 | 20,000 | Dark brown | 30 ma o/w | 30 ma w/o | 30 ma w/o |
| | | | Breaking | 5 ma o/w | 5 ma o/w | 5 ma o/w |
| | | | | 65 hw | 65 hw | 65 hw |
| 7-30 | 30 | 30,000 | Black | 23 ma w/o | 23 ma w/o | 23 ma w/o |
| | | | Breaking | 77 hw | 77 hw | 77 hw |
| 7-40 | 40 | 40,000 | Black | 21 ma w/o | 21 ma w/o | 21 ma w/o |

TABLE III-continued

| Exp. No. | Ml Brine Added | Conc. of Salts in Emulsion ppm | Observation of Stability of the o/w Emulsion Initial | 1 hr. | 4 hrs. | 24 hrs. |
|---|---|---|---|---|---|---|
| | | | Breaking | 79 hw | 79 hw | 79 hw |

These experiments show that 10,000 ppm of salts (Exp. 7-10) give some breaking of the emulsion as compared to the control Exp. 7-0. In experiments 7-20, 7-30 and 7-40, sufficient salt is present to produce good breaking of the o/w emulsion into an oil phase and water phase.

EXAMPLE 4

Breaking of a Low Surfactant Content o/w Emulsion With Brine

An emulsion was prepared by mixing 100 ml of crude oil, 100 ml of deionized water, and 250 ml of micellar fluid containing 0.5 wt.% surfactants of the same composition as Example 3. The tan o/w emulsion consisted of two stable o/w phases on standing. The emulsion contained 0.287 wt.% surfactant. One hundred ml of oil field brine containing 10 wt.% salts was added to the emulsion. The emulsion broke nicely at about 35 ml of brine addition, but an additional 65 ml of brine was added prior to shaking vigorously in a 500 ml graduated separatory funnel. After 30 minutes 125 ml of oil and 440 ml of hazy water had separated. A final separation was made at the end of 24 hours by draining the separated water from the separatory funnel to recover 442 ml of slightly hazy water containing no visible oil and 108 ml of oil phase.

The effectiveness of brine in breaking oil and water emulsion produced during recovery of an oil-water mixture from an underground reservoir has been demonstrated, and it will be understood that even though the present invention has been described with reference to specific surfactants, salts, concentrations, conditions, and the like, even other embodiments will become apparent which are within the spirit and scope of the invention defined in the following claims.

What is claimed is:

1. In a process for recovering crude oil from an underground reservoir wherein an oil-in-water emulsion of crude oil and water is recovered from the reservoir through a well therein, the method of breaking said emulsion for separation of the crude oil which consists essentially of mixing a naturally occurring brine with said emulsion in an amount sufficient to break the emulsion, agitating the mixture, and separating oil from the resulting broken emulsion.

2. A process as in claim 1 wherein said recovered emulsion contains a surfactant that was introduced into said reservoir prior to recovery of the emulsion.

3. A process as in claim 2 wherein the surfactant was introduced into said reservoir as a constituent of a micro-emulsion.

4. A process as in claim 2 wherein the surfactant is a sulfonate.

5. A process as in claim 1 wherein said brine includes alkaline earth metal salts.

6. A process as in claim 5 wherein said brine is removed from the same geologic formation wherein said reservoir resides.

7. A process as in claim 6 wherein said brine contains about 2–65% by weight of a mixture of salts.

8. A process as in claim 7 wherein about 3-15% by weight of the salts in said brine is one or more alkaline earth metals in ionized form.

9. A process as in claim 7 wherein said brine contains at least one part of an ionized alkaline earth metal salt per 30 parts of the combined total of alkali metal salts and alkaline earth metal salts therein.

10. A process as in claim 4 wherein the surfactant comprises a sodium petroleum sulfonate.

11. In a process for recovering crude oil from an underground reservoir wherein an oil-in-water emulsion which contains crude oil, water, and at least about 0.005 wt.% of a sulfonate surfactant is recovered from said underground reservoir through a producing well therein, the method of breaking said emulsion for separation of the crude oil which consists essentially of mixing a naturally occurring brine with said emulsion in an amount which incorporates in the mixture of brine and emulsion at leaet about 550 ppm of ionized salts of alkali metal salts and alkaline earth metal salts, followed by agitation of said mixture and separation of crude oil from the resulting broken emulsion.

12. A process as in claim 11 wherein said emulsion recovered from said reservoir contains at least about 0.025 weight percent of petroleum sulfonate, and from about 2000 ppm to about 250,000 ppm of a mixture of said salts are incorporated into said mixture of brine and emulsion upon mixing said brine therewith.

13. A process as in claim 12 wherein the brine mixed with the emulsion is brine which was removed from the formation wherein said reservoir resides.

14. A process as in claim 11 wherein said emulsion recovered from said formation contains from about 0.25 to about 2.5 weight percent of petroleum sulfonate, and from about 2000 ppm to about 40,000 ppm of a mixture of said salts are incorporated into the emulsion upon mixing said brine therewith.

15. A process as in claim 14 wherein at least from about 3000 ppm to about 20,000 ppm of said salts are incorporated into the emulsion.

16. A process as in claim 11 wherein the petroleum sulfonate has an average molecular weight within the range of about 350 to about 500.

17. A process as in claim 2 wherein said surfactant is a mixture comprising a sulfonate and sodium alcohol ethoxylate sulfonate.

* * * * *